US012736039B2

(12) United States Patent
Kim et al.

(10) Patent No.: US 12,736,039 B2
(45) Date of Patent: Sep. 15, 2026

(54) RECIPROCATING COMPRESSOR USING OUTER ROTOR MOTOR

(71) Applicant: Samsung Electronics Co., Ltd., Suwon-si (KR)

(72) Inventors: Kihwan Kim, Suwon-si (KR); Minjin Kim, Suwon-si (KR); Kisun Nam, Suwon-si (KR); Hyunwoo Ryu, Suwon-si (KR); Incheol Hwang, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 18/750,168

(22) Filed: Jun. 21, 2024

(65) Prior Publication Data

US 2024/0426286 A1 Dec. 26, 2024

Related U.S. Application Data

(63) Continuation of application No. PCT/KR2024/005426, filed on Apr. 22, 2024.

(30) Foreign Application Priority Data

Jun. 22, 2023 (KR) ..... 10-2023-0080668
Jul. 3, 2023 (KR) ..... 10-2023-0086075

(51) Int. Cl.
*F04B 35/04* (2006.01)
*F04B 39/14* (2006.01)
*F25B 31/02* (2006.01)

(52) U.S. Cl.
CPC ..... *F04B 35/04* (2013.01); *F04B 39/14* (2013.01); *F25B 31/026* (2013.01); *F25B 31/023* (2013.01)

(58) Field of Classification Search
CPC ..... F04B 35/04; F04B 35/39; F04B 35/14; F25B 31/023; F25B 31/026
See application file for complete search history.

(56) References Cited

U.S. PATENT DOCUMENTS 3,454,213 A * 7/1969 Valbjorn ..... F04B 35/04 417/415
4,682,065 A * 7/1987 English ..... H02K 5/1735 310/90

(Continued)

FOREIGN PATENT DOCUMENTS

DE 202018104495 U1 * 2/2019 ..... F16F 1/12
EP 3 141 749 B1 8/2018

(Continued)

OTHER PUBLICATIONS

Machine Translation of JP 2004324722 (Year: 2004).*

(Continued)

*Primary Examiner* — Christopher S Bobish
(74) *Attorney, Agent, or Firm* — Jefferson IP Law, LLP

(57) ABSTRACT

A reciprocating compressor is provided. The reciprocating compressor includes a bearing block, a fixed shaft extending vertically from a lower surface of the bearing block, formed in a cylindrical shape, and having a shaft hole formed therein, a stator disposed on the bearing block and including a coupling hole into which the fixed shaft is inserted, a holder disposed on an outer circumferential surface of the fixed shaft and configured to fix the stator to the bearing block, a rotating shaft inserted into the shaft hole of the fixed shaft, and a rotor disposed outside the stator and fixed to one end of the rotating shaft. The outer circumferential surface of the fixed shaft and the shaft hole may be formed concentrically.

14 Claims, 16 Drawing Sheets

(56) References Cited

U.S. PATENT DOCUMENTS

| | | | | | |
|---|---|---|---|---|---|
| 5,033,941 | A * | 7/1991 | Jensen | B23P 11/025 417/415 |
| 5,363,003 | A * | 11/1994 | Harada | H02K 11/33 310/216.118 |
| 9,303,635 | B2 | 4/2016 | Ueda | |
| 9,541,077 | B2 * | 1/2017 | Kim | F04B 39/14 |
| 10,001,116 | B2 * | 6/2018 | Yanase | F04B 39/122 |
| 10,830,222 | B2 * | 11/2020 | Kawano | F04B 41/02 |
| 11,421,669 | B2 * | 8/2022 | Lee | F04B 39/122 |
| 11,536,258 | B2 | 12/2022 | Lee et al. | |
| 2013/0052056 | A1 * | 2/2013 | Kim | F04B 35/04 417/410.1 |
| 2017/0009755 | A1 * | 1/2017 | Yanase | F25B 31/023 |
| 2017/0058880 | A1 * | 3/2017 | Iida | F25B 31/023 |
| 2021/0215143 | A1 | 7/2021 | Lee et al. | |

FOREIGN PATENT DOCUMENTS

| | | | | |
|---|---|---|---|---|
| JP | 2004324722 | A * | 11/2004 | |
| JP | 2014-001699 | A | 1/2014 | |
| JP | 6266304 | B2 | 1/2018 | |
| JP | 2020-112032 | A | 7/2020 | |
| KR | 10-2011-0081467 | A | 7/2011 | |
| KR | 10-1918067 | B1 | 11/2018 | |
| KR | 10-2150445 | B1 | 9/2020 | |
| KR | 10-2021-0090028 | A | 7/2021 | |
| KR | 10-2319349 | B1 | 10/2021 | |
| WO | 2016/006229 | A1 | 1/2016 | |
| WO | WO-2017033413 | A1 * | 3/2017 | H02K 1/2786 |
| WO | WO-2017081923 | A1 * | 5/2017 | F16F 1/32 |

OTHER PUBLICATIONS

International Search Report with Written Opinion and English translation dated Aug. 6, 2024; International Appln. No. PCT/KR2024/005426.

* cited by examiner

RECIPROCATING COMPRESSOR USING OUTER ROTOR MOTOR

CROSS-REFERENCE TO RELATED APPLICATION(S)

This application is a continuation application, claiming priority under § 365(c), of an International application No. PCT/KR2024/005426, filed on Apr. 22, 2024, which is based on and claims the benefit of a Korean patent application number 10-2023-0080668, filed on Jun. 22, 2023, in the Korean Intellectual Property Office, and of a Korean patent application number 10-2023-0086075, filed on Jul. 3, 2023, in the Korean Intellectual Property Office, the disclosure of each of which is incorporated by reference herein in its entirety.

TECHNICAL FIELD

The disclosure relates to a reciprocating compressor. More particularly, the disclosure relates to a reciprocating compressor using an outer rotor motor.

BACKGROUND ART

A compressor is a mechanical device that compresses incoming gas, increases the pressure of the gas, and discharges the compressed gas. The compressor may generally be categorized into two types, namely a reciprocating type compressor and a rotating type compressor, according to its operating principle.

The rotating type compressor may generally be categorized into two sub-types, including a rotary compressor and a scroll compressor.

The reciprocating type compressor may include a reciprocating compressor that converts a rotational motion of a motor into a linear reciprocating motion of a piston using a crankshaft and a connecting rod so as to suck, compress, and discharge gas.

Generally, the reciprocating compressor uses an inner rotor motor to generate rotational force.

However, because the inner rotor motor has a rotor disposed inside a stator, the moment of inertia of the rotor may be limited by the size of the stator.

The above information is presented as background information only to assist with an understanding of the disclosure. No determination has been made, and no assertion is made, as to whether any of the above might be applicable as prior art with regard to the disclosure.

DISCLOSURE OF INVENTION

Aspects of the disclosure are to address at least the above-mentioned problems and/or disadvantages and to provide at least the advantages described below. Accordingly, an aspect of the disclosure is to provide a reciprocating compressor using an outer rotor motor.

Additional aspects will be set forth in part in the description which follows and, in part, will be apparent from the description, or may be learned by practice of the presented embodiments.

Technical Solution

In accordance with an aspect of the disclosure, a reciprocating compressor is provided. The reciprocating compressor includes a bearing block, a fixed shaft extending vertically from a lower surface of the bearing block, formed in a cylindrical shape, and having a shaft hole formed therein, a stator disposed on the bearing block and including a coupling hole into which the fixed shaft is inserted, a holder disposed on an outer circumferential surface of the fixed shaft and configured to fix the stator to the bearing block, a rotating shaft inserted into the shaft hole of the fixed shaft, and a rotor disposed outside the stator and fixed to one end of the rotating shaft. The outer circumferential surface of the fixed shaft and the shaft hole may be formed concentrically.

According to one or more embodiments of the disclosure, concentricity of the outer circumferential surface of the fixed shaft and the shaft hole may be less than 0.5 micrometers (μm).

According to one or more embodiments of the disclosure, the holder includes a fastener. The fastener includes a ring portion having an inner diameter larger than a diameter of the fixed shaft, and a plurality of pressing portions protruding from an inner circumferential surface of the ring portion toward a center thereof. The plurality of pressing portions may be formed to be inclined with respect to the ring portion.

According to one or more embodiments of the disclosure, the diameter of the fixed shaft may be larger than an inner diameter of the plurality of pressing portions. Difference between the diameter of the fixed shaft and the inner diameter of the plurality of pressing portions may be 0.05 millimeters (mm) to 0.3 mm.

According to one or more embodiments of the disclosure, the fastener may be formed so that when the fastener is coupled to the fixed shaft, one surface of the fastener facing the stator is double inclined with respect to a contact surface of the stator.

According to one or more embodiments of the disclosure, the holder includes a snap ring. The fixed shaft includes a ring groove in which the snap ring is accommodated. A spring washer may be disposed between the bearing block and the stator.

According to one or more embodiments of the disclosure, the reciprocating compressor includes a rotation prevention part provided between the fixed shaft and the bearing block. The stator may include a fixing groove formed on one surface of the stator facing the bearing block and corresponding to the rotation prevention part.

According to one or more embodiments of the disclosure, the rotation prevention part may be formed as a step portion including a D-cut portion. The fixing groove may be formed as a D-cut groove corresponding to the step portion including the D-cut portion.

According to one or more embodiments of the disclosure, a diameter of coupling hole of the stator may be larger than a diameter of the fixed shaft. Difference between the diameter of the coupling hole of the stator and the diameter of the fixed shaft may be 0.1 mm to 0.3 mm.

According to one or more embodiments of the disclosure, the rotor includes a disk, a skirt extending vertically from an edge of the disk, and a fixed boss disposed at a center of the disk. One end of the rotating shaft may be press-fitted to the fixed boss.

In accordance with another aspect of the disclosure, a method of assembling a reciprocating compressor is provided. The method includes preparing a bearing block, inserting a fixed shaft of the bearing block into a stator, disposing a holder on the fixed shaft to fix the stator, inserting a rotating shaft into a shaft hole of the fixed shaft, and coupling a rotor to the rotating shaft.

According to one or more embodiments of the disclosure, the inserting the fixed shaft of the bearing block into the stator includes inserting a rotation prevention part of the bearing block into a fixing groove of the stator.

According to one or more embodiments of the disclosure, the disposing the holder on the fixed shaft to fix the stator includes press-fitting a fastener into the fixed shaft so that the fastener contacts an upper surface of the stator.

According to one or more embodiments of the disclosure, the method of assembling a reciprocating compressor further includes inserting a spring washer into the fixed shaft before inserting the fixed shaft of the bearing block into the stator. The disposing the holder on the fixed shaft to fix the stator includes inserting a snap ring into a ring groove of the fixed shaft.

According to one or more embodiments of the disclosure, the coupling the rotor to the rotating shaft includes press-fitting one end of the rotating shaft into a fixed boss of the rotor.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF DRAWINGS

These and/or other aspects, features, and advantages of certain embodiments of the disclosure will be more apparent from the following description taken in conjunction with the accompanying drawings, in which.

Throughout the drawings, it should be noted that like reference numbers are used to depict the same or similar elements, features, and structures.

BEST MODE FOR CARRYING OUT THE INVENTION

Figure 1:
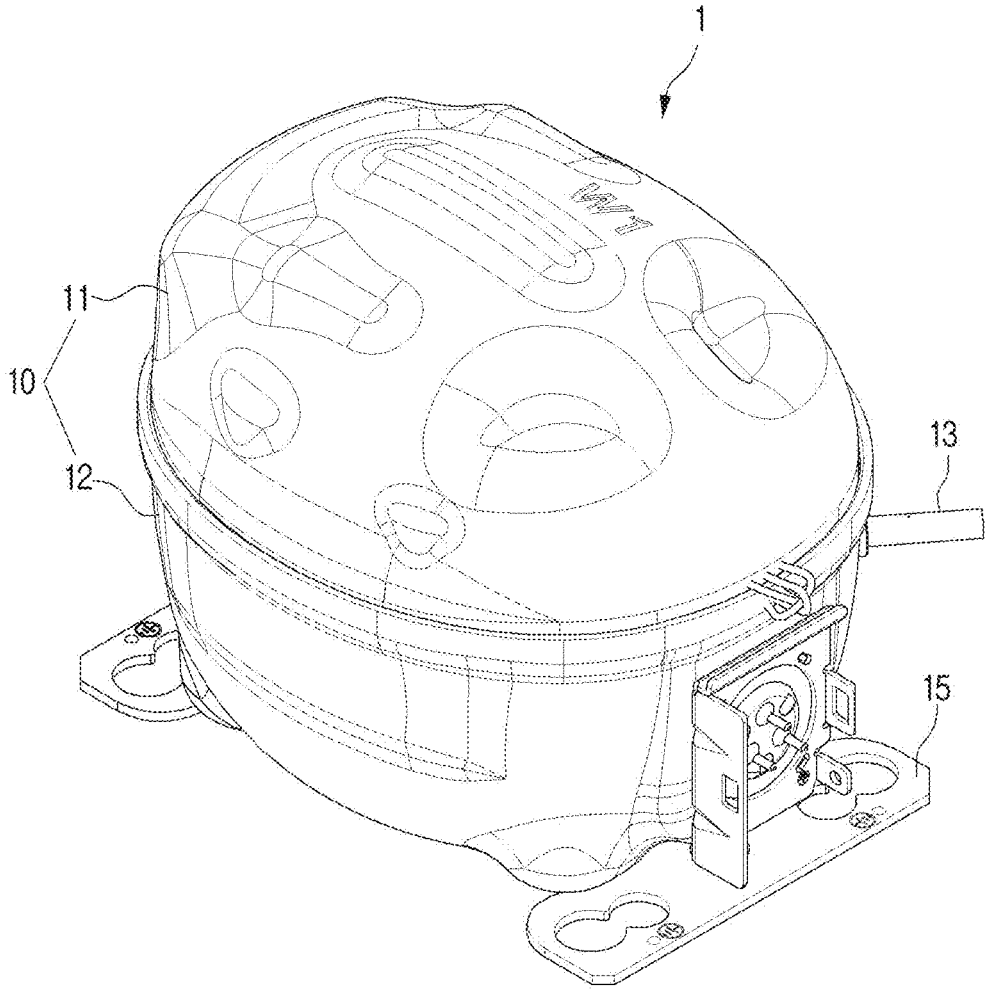
FIG. 1 is a perspective view illustrating a reciprocating compressor 1 according to an embodiment of the disclosure.

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

In connection with the description of the drawings, similar reference numbers may be used for similar or related components.

In this document, each of phrases such as "A or B," "at least one of A and B," "at least one of A or B," "A, B, or C," "at least one of A, B, and C," "at least one of A, B, C" may include any one of the items listed together with the corresponding phrase, or any possible combination thereof.

The term "and/or" includes any element of a plurality of related described elements or a combination of a plurality of related described elements.

Terms such as "first," "second," "primary," or "secondary" may be used simply to distinguish one component from other components, and do not limit the corresponding components in other respects (e.g., importance or order).

When it is mentioned that one (e.g., first) component is "coupled" or "connected" to another (e.g., second) component with or without terms "functionally" or "communicatively", it means that the one component can be connected to the another component directly (e.g., wired), wirelessly, or through a third component.

Terms such as "include" or "have" are intended to designate the presence of features, numbers, steps, operations, components, parts, or combinations thereof described in the embodiment, but do not preclude the presence or addition of one or more other features, numbers, steps, operations, components, parts, or combination thereof.

When a component is said to be "connected," "coupled," "supported," or "in contact" with another component, this means not only cases where the components are directly connected, coupled, supported, or contacted, but also cases where the components are indirectly connected, coupled, supported, or contacted through a third component.

When a component is said to be located "on" other component, this includes not only cases where the component is in contact with the other component, but also cases where another component exits between the two components.

Further, the terms 'leading end', 'rear end', 'upper side', 'lower side', 'top end', 'bottom end', etc. used in the disclosure are defined with reference to the drawings. However, the shape and position of each component are not limited by the terms.

It should be appreciated that the blocks in each flowchart and combinations of the flowcharts may be performed by one or more computer programs which include instructions. The entirety of the one or more computer programs may be stored in a single memory or the one or more computer programs may be divided with different portions stored in different multiple memories.

Any of the functions or operations described herein can be processed by one processor or a combination of processors. The one processor or the combination of processors is circuitry performing processing and includes circuitry like an application processor (AP, e.g. a central processing unit (CPU)), a communication processor (CP, e.g., a modem), a graphical processing unit (GPU), a neural processing unit (NPU) (e.g., an artificial intelligence (AI) chip), a Wi-Fi chip, a Bluetooth® chip, a global positioning system (GPS) chip, a near field communication (NFC) chip, connectivity chips, a sensor controller, a touch controller, a finger-print sensor controller, a display drive integrated circuit (IC), an audio CODEC chip, a universal serial bus (USB) controller, a camera controller, an image processing IC, a microprocessor unit (MPU), a system on chip (SoC), an integrated circuit (IC), or the like.

The disclosure relates a hermetic reciprocating compressor 1 that may improve low-speed efficiency and reduce noise and vibration by using an outer rotor motor 30 that may maximize the moment of inertia of a rotor 50.

Hereinafter, a reciprocating compressor 1 according to one or more embodiments of the disclosure will be described in detail with reference to the attached drawings.

FIG. 1 is a perspective view illustrating a reciprocating compressor 1 according to an embodiment of the disclosure.

Referring to FIG. 1, a reciprocating compressor 1 according to one or more embodiments of the disclosure may include a casing 10.

The casing 10 forms the exterior of the reciprocating compressor 1. The casing 10 is formed as a sealed container. The casing 10 may include a refrigerant inlet pipe 13 through which a refrigerant flows in and a refrigerant discharge pipe 14 (not shown in FIG. 1) through which the refrigerant is discharged.

The reciprocating compressor 1 may form a refrigeration cycle with a condenser, an expansion valve, and an evaporator. In this case, the refrigerant inlet pipe 13 may be connected to the evaporator, and the refrigerant discharge pipe 14 may be connected to the condenser.

The casing 10 may include an upper casing 11 and a lower casing 12. The upper casing 11 is coupled to the upper end of the lower casing 12 to form the casing 10.

The joint portion of the upper casing 11 and the lower casing 12 may be hermetic.

The lower casing 12 is provided with the refrigerant inlet pipe 13 and the refrigerant discharge pipe 14. The refrigerant inlet pipe 13 and the refrigerant discharge pipe 14 communicate with a compression part 80 disposed inside the casing 10. Low-temperature and low-pressure refrigerant may flow into the refrigerant inlet pipe 13. High-temperature and high-pressure refrigerant compressed in the compression part 80 may be discharged to the outside of the casing 10 through the refrigerant discharge pipe 14.

A base 15 supporting the casing 10 may be provided at the bottom of the lower casing 12. The reciprocating compressor 1 may be disposed perpendicular to the support surface by the base 15.

Figure 2:
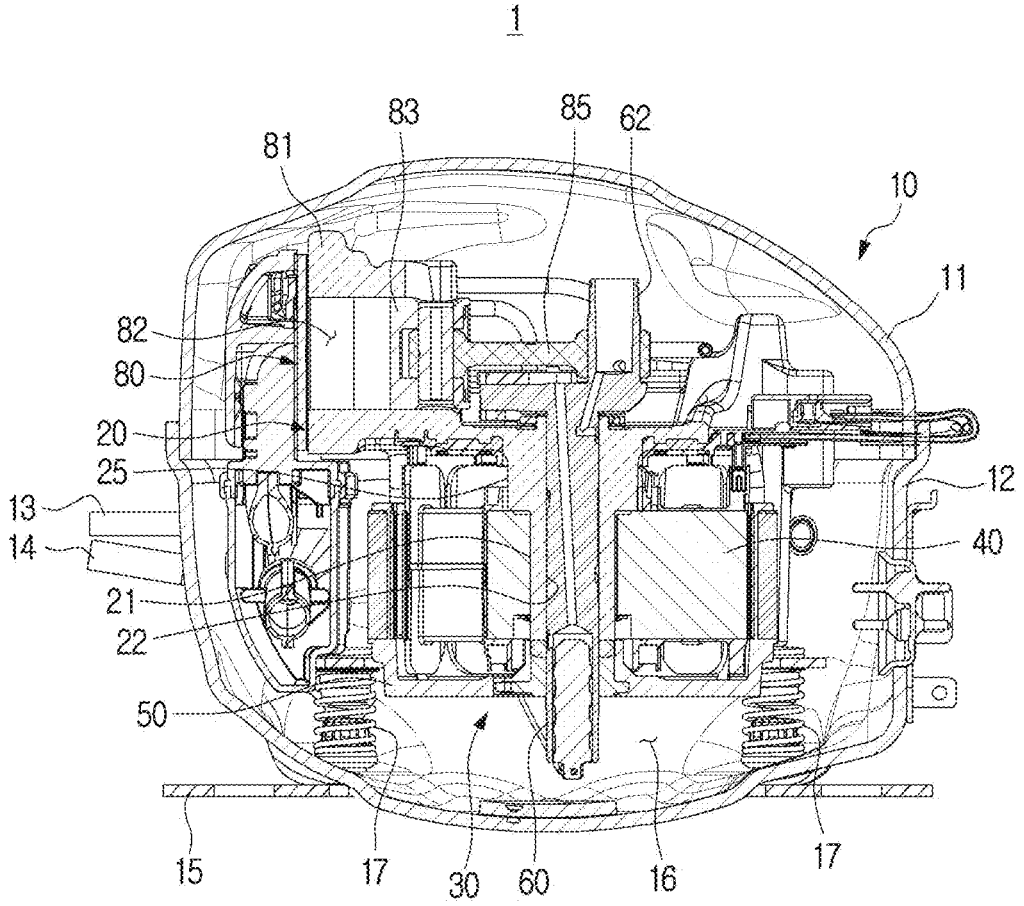
FIG. 2 is a cross-sectional view illustrating a reciprocating compressor 1 according to an embodiment of the disclosure.

FIG. 2 is a cross-sectional view illustrating a reciprocating compressor 1 according to an embodiment of the disclosure.

Figure 3:
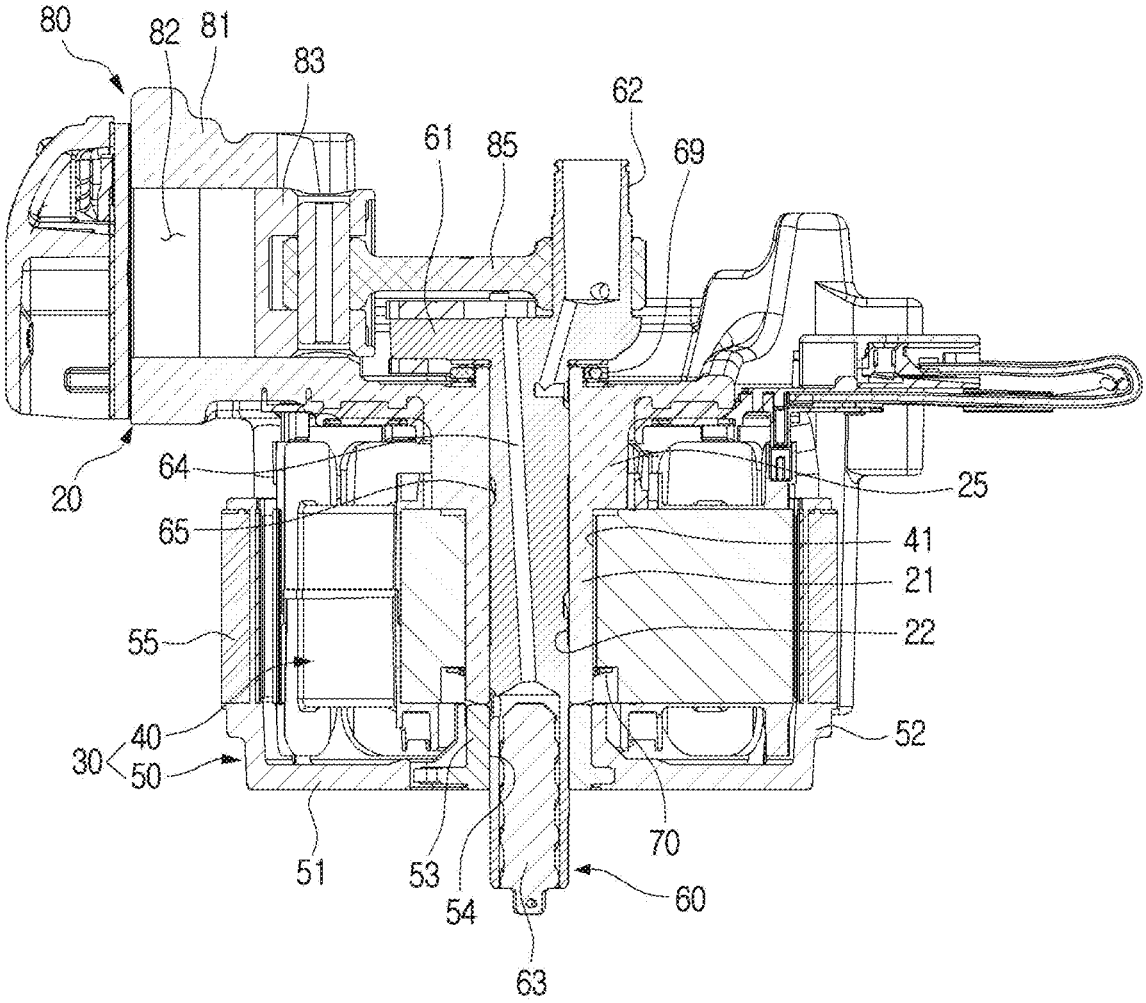
FIG. 3 is an enlarged partial cross-sectional view illustrating a motor 30 of the reciprocating compressor 1 of FIG. 2 according to an embodiment of the disclosure.

FIG. 3 is an enlarged partial cross-sectional view illustrating a motor 30 of the reciprocating compressor 1 of FIG. 2 according to an embodiment of the disclosure.

Figure 4:
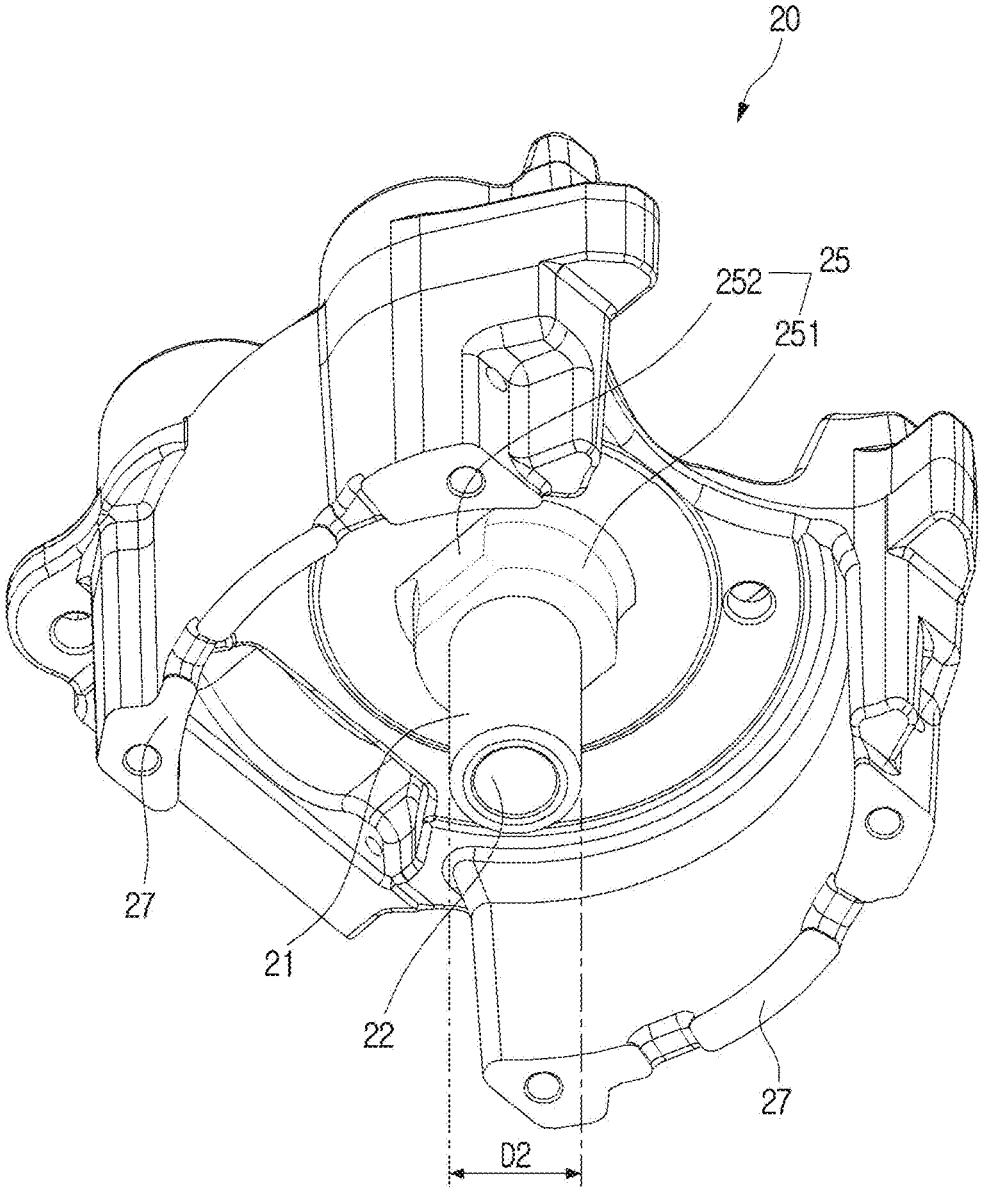
FIG. 4 is a bottom perspective view illustrating a bearing block 20 used in a reciprocating compressor 1 according to an embodiment of the disclosure.

FIG. 4 is a bottom perspective view illustrating a bearing block 20 used in a reciprocating compressor 1 according to an embodiment of the disclosure.

Figure 5:
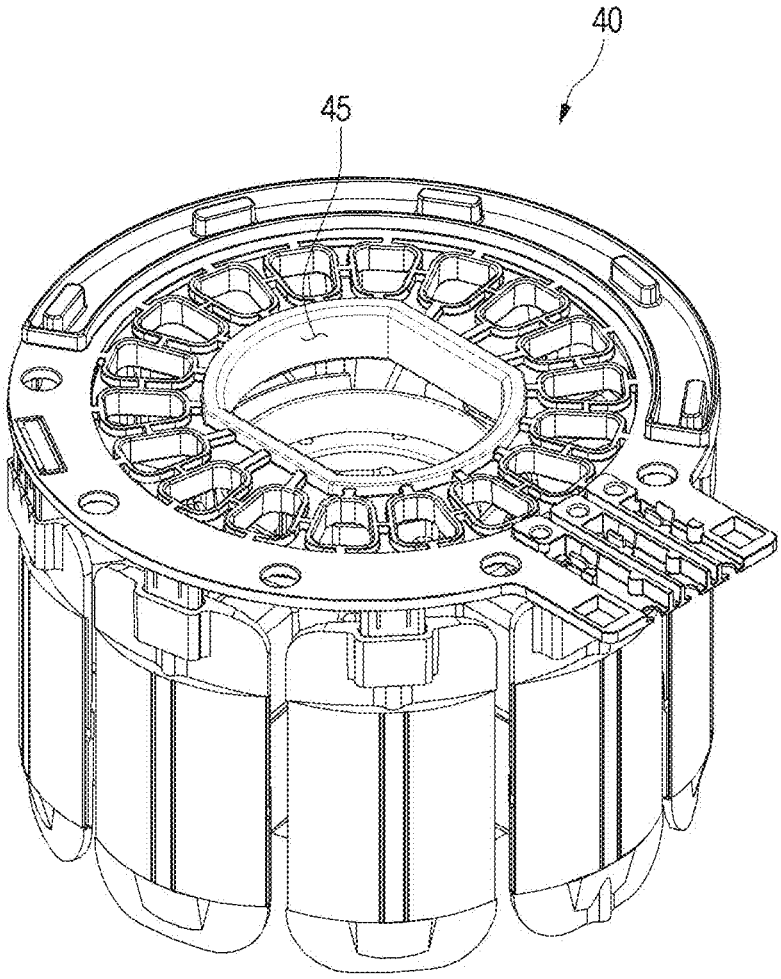
FIG. 5 is a perspective view illustrating a stator 40 used in a reciprocating compressor 1 according to an embodiment of the disclosure.

FIG. 5 is a perspective view illustrating a stator 40 used in a reciprocating compressor 1 according to an embodiment of the disclosure.

Figure 6:
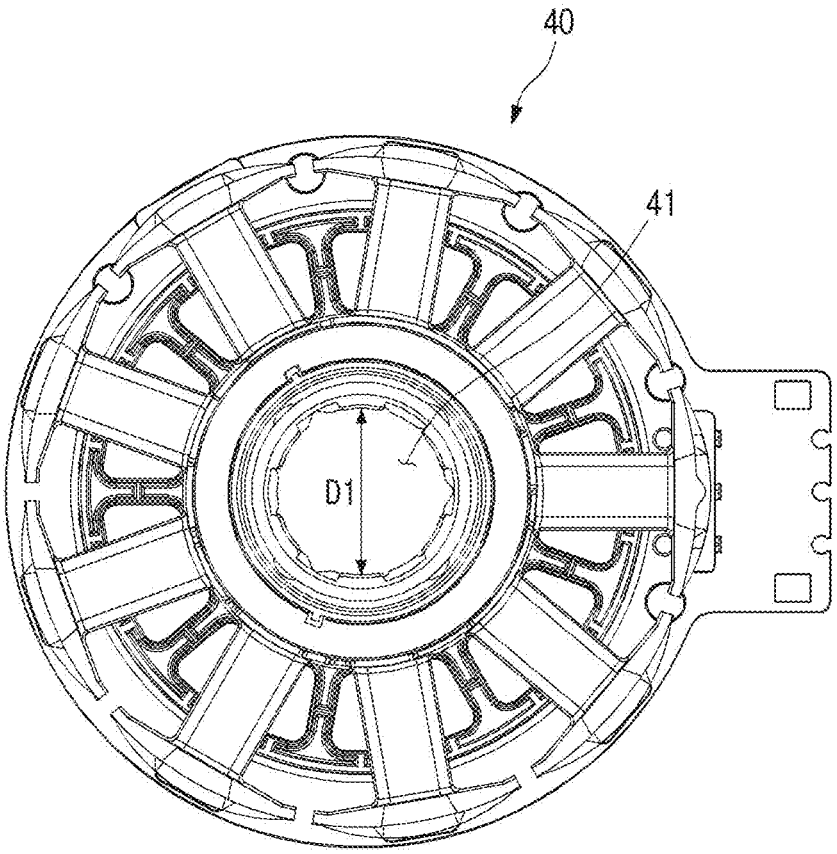
FIG. 6 is a bottom view illustrating a stator 40 used in a reciprocating compressor 1 according to an embodiment of the disclosure.

FIG. 6 is a bottom view illustrating a stator 40 used in a reciprocating compressor 1 according to an embodiment of the disclosure.

Referring to FIGS. 2 and 3, the reciprocating compressor 1 according to one or more embodiments of the disclosure may include a casing 10, a bearing block 20, a motor 30, and a compression part 80.

The casing 10 forms the exterior of the reciprocating compressor 1 and may be formed as a hermetic container. The bearing block 20, the motor 30, and the compression part 80 may be disposed inside the casing 10. The casing 10 may include a lower casing 12 and an upper casing 11 covering the upper side of the lower casing 12.

The casing 10 is formed by coupling the upper casing 11 and the lower casing 12, and the inside of the casing 10 except the refrigerant inlet pipe 13 and the refrigerant discharge pipe 14 may be hermetic. In other words, the refrigerant may flow into the inside of the casing 10 only through the refrigerant inlet pipe 13, and may be discharged to the outside of the casing 10 only through the refrigerant discharge pipe 14.

An oil reservoir 16 containing oil may be provided in the lower part of the lower casing 12.

The bearing block 20 is disposed inside the casing 10. The motor 30 may be disposed at the lower part of the bearing block 20, and the compression part 80 may be disposed at the upper part of the bearing block 20.

The bearing block 20 may be disposed at the bottom of the lower casing 12. The bearing block 20 may be supported by a pair of elastic supporters 17 disposed at the bottom of the lower casing 12.

Referring to FIGS. 2, 3, and 4, the bearing block 20 may include a fixed shaft 21. The fixed shaft 21 may be formed to extend vertically downward from the lower surface of the bearing block 20. The fixed shaft 21 may be formed in a cylindrical shape.

A shaft hole 22 may be formed inside the fixed shaft 21. The shaft hole 22 may be formed to have a circular cross-section. The shaft hole 22 is formed to penetrate the fixed shaft 21 and the bearing block 20 vertically.

The outer circumferential surface of the fixed shaft 21 and the shaft hole 22 may be formed to be concentric. The concentricity of the outer circumferential surface of the fixed shaft 21 and the shaft hole 22 may be small. For example, the concentricity of the outer circumferential surface of the fixed shaft 21 and the shaft hole 22 may be less than 0.5 micrometers (μm).

A stator 40 is disposed on the outer circumferential surface of the fixed shaft 21, and a rotating shaft 60 is inserted into the shaft hole 22 of the fixed shaft 21.

The inner circumferential surface of the shaft hole 22 is surface processed to function as a bearing that supports the rotation of the rotating shaft 60. Therefore, the rotating shaft 60 may rotate relative to the fixed shaft 21 while inserted in the shaft hole 22.

Accordingly, the center of the stator 40 and the center of the rotating shaft 60, e.g., the center of the rotor 50, may be aligned by the fixed shaft 21.

A rotation prevention part 25 may be provided between the fixed shaft 21 and the lower surface of the bearing block 20. The rotation prevention part 25 may be formed to prevent the stator 40 from rotating with respect to the fixed shaft 21.

For example, the rotation prevention part 25 may include a cylindrical step portion 251 provided on the upper end of the fixed shaft 21 and a D-cut portion 252 provided on the side surface of the step portion 251. In other words, the rotation prevention part 25 may be formed as the step portion 251 including the D-cut portion 252. The step portion 251 may be formed to have a larger diameter than the fixed shaft 21. The step portion 251 may include a plurality of D-cut portions 252. In this embodiment, the step portion 251 includes two D-cut portions 252.

A fixing groove 45 corresponding to the rotation prevention part 25 may be formed on one surface of the stator 40 facing the lower surface of the bearing block 20. In the case of this embodiment, the fixing groove 45 of the stator 40 may be formed as a D-cut groove corresponding to the step portion 251 including two D-cut portions 252.

However, the shape of the rotation prevention part 25 is not limited to this. The rotation prevention part 25 may be formed in various structures as long as it can prevent the stator 40 from rotating with respect to the fixed shaft 21. For example, the rotation prevention part 25 may be formed as a protrusion protruding downward from the lower surface of the bearing block 20 and spaced a certain distance from the fixed shaft 21. In this case, the stator 40 may include a groove corresponding to the protrusion. Therefore, when the protrusion of the bearing block 20 is inserted into the groove of the stator 40, the stator 40 does not rotate.

The bearing block 20 may include a pair of legs 27 extending downward from the lower surface thereof. The pair of legs 27 may be formed symmetrically about the fixed shaft 21. In other words, the fixed shaft 21 may be formed between the pair of legs 27. However, the pair of legs 27 may be formed asymmetrically about the fixed shaft 21.

To prevent interference with the stator 40 disposed on the fixed shaft 21, the inner surfaces of the pair of legs 27 may be formed as a concave curved surface corresponding to the outer circumferential surface of the stator 40. The inner surfaces of the pair of legs 27 are spaced apart from the outer circumferential surface of the stator 40 by a predetermined distance.

The lower surfaces of the pair of legs 27 may be supported by the pair of elastic supporters 17. The upper end of the elastic supporter 17 may be fixed to the lower surface of the leg 27, and the lower end of the elastic supporter 17 may be fixed to the bottom of the lower casing 12. Each of the pair of elastic supporters 17 may be formed of a coil spring.

The motor 30 may be disposed below the bearing block 20. The motor 30 may be configured to generate a rotational force to operate the compression part 80. The motor 30 may include a stator 40 and a rotor 50.

The stator 40 may be disposed on the lower surface of the bearing block 20. The stator 40 may include a stator core and a coil. The stator core may be formed by stacking pressed steel plates.

Referring to FIGS. 2, 3, 5, and 6, the stator 40 may include a coupling hole 41. The coupling hole 41 is formed at the center of the stator 40, e.g., at the center of the stator core.

The fixed shaft 21 may be inserted into the coupling hole 41. The diameter of the coupling hole 41 may be larger than the diameter of the fixed shaft 21. For example, the difference between the diameter D1 of the coupling hole 41 of the stator 40 and the diameter D2 of the fixed shaft 21 may be 0.1 millimeters (mm) to 0.3 mm.

In the case that the difference between the diameter D1 of the coupling hole 41 of the stator 40 and the diameter D2 of the fixed shaft 21 is less than 0.1 mm, when the fixed shaft 21 is inserted into the coupling hole 41 of the stator 40, interference between the fixed shaft 21 and the coupling hole 41 of the stator 40 may occur. When interference occurs between the fixed shaft 21 and the coupling hole 41 of the stator 40, the bearing formed in the shaft hole 22 of the fixed shaft 21 may be deformed. When the bearing formed in the shaft hole 22 is deformed, the rotating shaft 60 rotatably supported by the shaft hole 22 may not rotate smoothly. Therefore, noise may occur during operation of the reciprocating compressor 1.

When the difference between the diameter D1 of the coupling hole 41 of the stator 40 and the diameter D2 of the fixed shaft 21 exceeds 0.3 mm, the center of the rotating shaft 60 inserted into the shaft hole 22 of the fixed shaft 21 and the center of the stator 40 deviate from a predetermined range. Then, the air gap between the rotor 50 rotating integrally with the rotating shaft 60 and the stator 40 may not be constant and may be eccentric. When the air gap between the rotor 50 and the stator 40 is not constant, noise and vibration may occur during operation of the reciprocating compressor 1.

A fixing groove 45 may be provided on at least one surface of the stator 40, e.g., on the upper surface of the stator 40 facing the bearing block 20. The fixing groove 45 may be formed to correspond to the rotation prevention part 25 of the bearing block 20. In this embodiment, the fixing groove 45 is formed as a D-cut groove having two D-cut portions corresponding to the step portion 251 including two D-cut portions 252 of the fixed shaft 21.

Accordingly, when the step portion 251 of the fixed shaft 21 is inserted into the D-cut groove 45 of the stator 40, the stator 40 does not rotate with respect to the fixed shaft 21.

The stator 40 may be fixed to the fixed shaft 21. The stator 40 may be fixed to the fixed shaft 21 by a holder (e.g., a fastener 70 or a snap ring 77). The holder (e.g., the fastener 70 or the snap ring 77) may be disposed on the outer circumferential surface of the fixed shaft 21.

In detail, with the rotation prevention part 25 of the bearing block 20 inserted into the fixing groove 45 on the upper surface of the stator 40, when the holder (e.g., the fastener 70 or the snap ring 77) is disposed on the fixed shaft 21 so that the holder (e.g., the fastener 70 or the snap ring 77) is in contact with the lower surface of the stator 40, the stator 40 is fixed to the fixed shaft 21 of the bearing block 20. In other words, when the holder (e.g., the fastener 70 or the snap ring 77) is fixed to the fixed shaft 21, the stator 40 may be fixed to the bearing block 20. When the stator 40 is fixed to the fixed shaft 21 by the holder (e.g., the fastener 70 or the snap ring 77), the stator 40 may not move up and down with respect to the fixed shaft 21.

The holder may include the fastener 70 or the snap ring 77.

The rotor 50 is disposed outside the stator 40. In other words, the stator 40 is disposed inside the rotor 50. Accordingly, the rotor 50 may rotate around the stator 40 outside of the stator 40.

The rotor 50 may be fixed to one end of the rotating shaft 60. Therefore, when the rotor 50 rotates, the rotating shaft 60 may rotate integrally with the rotor 50.

The rotor 50 may be formed in a circular container shape. In other words, the rotor 50 may be formed in a hollow cylindrical shape with one end closed and the other end open. The stator 40 may be accommodated inside the rotor 50.

The rotor 50 may include a disk 51, a skirt 52, and a fixed boss 53.

The skirt 52 extends vertically from the edge of the disk 51. In other words, the skirt 52 is formed in a hollow cylindrical shape. The skirt 52 may be formed integrally with the disk 51.

A plurality of permanent magnets 55 are disposed in the skirt 52. The plurality of permanent magnets 55 may be arranged at regular intervals in the circumferential direction of the skirt 52. The skirt 52 is formed at a predetermined distance from the stator 40. The gap between the plurality of permanent magnets 55 disposed on the skirt 52 and the outer circumferential surface of the stator 40 forms an air gap.

The fixed boss 53 is fixed to the center of the disk 51. For example, the fixed boss 53 may be formed on the disk 51 by injection molding.

The fixed boss 53 may be formed so that the rotating shaft 60 is press-fitted and fixed to the fixed boss 53. For example, the fixed boss 53 includes a through hole 54. The through hole 54 is formed to penetrate the upper and lower surfaces of the fixed boss 53. The diameter of the through hole 54 of the fixed boss 53 may be determined to fit tightly with the rotating shaft 60. For example, the fixed boss 53 may be press-fitted to the rotating shaft 60. Accordingly, when the rotor 50 rotates, the rotating shaft 60 may rotate integrally with the rotor 50.

The rotating shaft 60 is inserted into the shaft hole 22 of the fixed shaft 21 of the bearing block 20. The rotating shaft 60 is rotatably supported by the shaft hole 22. Accordingly, when the rotor 50 rotates, the rotating shaft 60 may rotate inside the shaft hole 22 of the fixed shaft 21.

A head portion 61 is provided at the top of the rotating shaft 60. The head portion 61 is formed to have a diameter larger than the diameter of the rotating shaft 60. The head portion 61 is formed to rotate integrally with the rotating shaft 60.

A bearing 69 is disposed between the head portion 61 and the upper surface of the bearing block 20. Accordingly, when the rotating shaft 60 rotates, the head portion 61 may rotate with respect to the upper surface of the bearing block 20.

A crank shaft 62 is provided on the upper surface of the head portion 61. The crank shaft 62 is formed perpendicular to the upper surface of the head portion 61. The crank shaft 62 is formed to be eccentric with the rotating shaft 60. In other words, the center line of the rotating shaft 60 is spaced apart from the center line of the crank shaft 62 by a predetermined distance. A connecting rod 85 may be connected to the crank shaft 62.

An oil pump 63 may be disposed at the lower portion of the rotating shaft 60. The lower portion of the rotating shaft 60 in which the oil pump 63 is disposed is integrally coupled with the rotor 50. The lower end of the rotating shaft 60 may protrude below the rotor 50 and may be immersed in the oil reservoir 16.

The rotating shaft 60 may include an oil supply path. The oil supply path may include a first oil passage 64 formed to vertically penetrate the rotating shaft 60 and a second oil passage 65 formed in a helical shape on the outer circumferential surface of the rotating shaft 60.

Accordingly, when the rotating shaft 60 rotates, oil in the oil reservoir 16 may be supplied upward by the oil pump 63. Some of the oil supplied by the oil pump 63 may be supplied to the upper side of the rotating shaft 60 along the first oil passage 64. In addition, the remaining oil may be supplied between the outer circumferential surface of the rotating shaft 60 and the inner circumferential surface of the shaft hole 22 through the second oil passage 65.

The compression part 80 is configured to compress and discharge the refrigerant introduced through the refrigerant inlet pipe 13. The compression part 80 may be provided on the upper surface of the bearing block 20.

The compression part 80 may include a cylinder block 81, a piston 83, and a connecting rod 85.

The cylinder block 81 is formed on the upper surface of the bearing block 20. A compression chamber 82 having a circular cross-section is formed inside the cylinder block 81. An inlet valve and a discharge valve are provided at the outer end of the cylinder block 81.

The piston 83 is inserted into the hollow of the cylinder block 81. The piston 83 is formed to linearly reciprocate a certain distance along the inner surface of the compression chamber 82 of the cylinder block 81.

The piston 83 is connected to one end of the connecting rod 85. The other end of the connecting rod 85 is connected to the crank shaft 62 of the rotating shaft 60. Accordingly, when the rotating shaft 60 rotates, the piston 83 may make a linear reciprocating motion in the compression chamber 82 of the cylinder block 81 by the crank shaft 62 and the connecting rod 85.

When the piston 83 linearly reciprocates in the compression chamber 82 of the cylinder block 81, the refrigerant may flow into the compression chamber 82 through the inlet valve, may be compressed, and then may be discharged to the outside of the compression chamber 82 through the discharge valve.

Hereinafter, the fastener 70 used in the reciprocating compressor 1 according to one or more embodiments of the disclosure will be described in detail with reference to FIGS. 7 to 10.

The fastener 70 may be formed to be inserted into the fixed shaft 21 of the bearing block 20 and secure the stator 40 to the fixed shaft 21.

Figure 7:
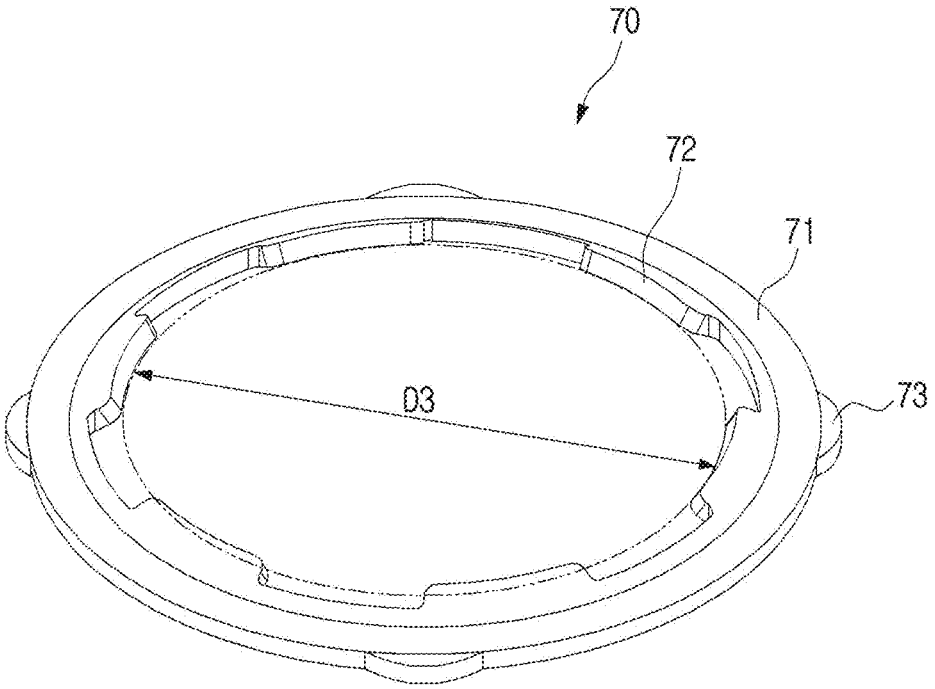
FIG. 7 is a perspective view illustrating a fastener 70 used in a reciprocating compressor 1 according to an embodiment of the disclosure.

FIG. 7 is a perspective view illustrating a fastener 70 used in a reciprocating compressor 1 according to an embodiment of the disclosure.

Figure 8:
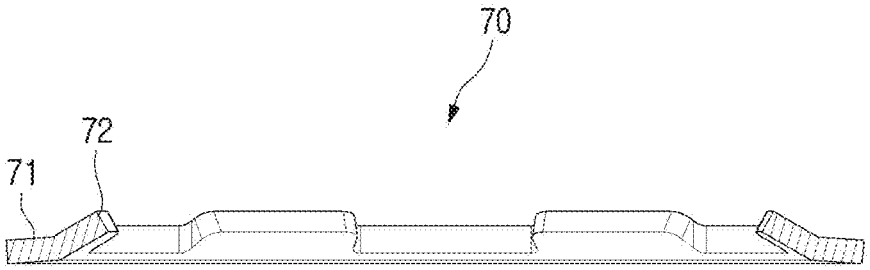
FIG. 8 is a cross-sectional view illustrating a fastener 70 used in a reciprocating compressor 1 according to an embodiment of the disclosure.

FIG. 8 is a cross-sectional view illustrating a fastener 70 used in a reciprocating compressor 1 according to an embodiment of the disclosure.

Figure 9:
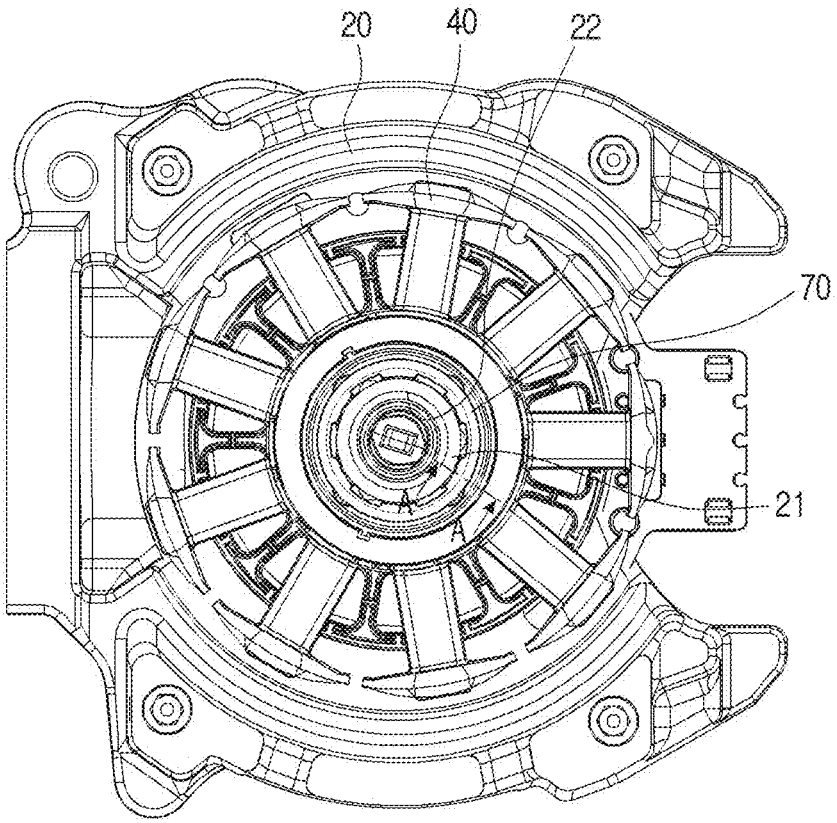
FIG. 9 is a view illustrating a state in which a fastener 70 according to one or more embodiments of the disclosure is coupled to a fixed shaft 21 according to an embodiment of the disclosure.

FIG. 9 is a view illustrating a state in which a fastener 70 is coupled to a fixed shaft 21 according to an embodiment of the disclosure.

Figure 10:
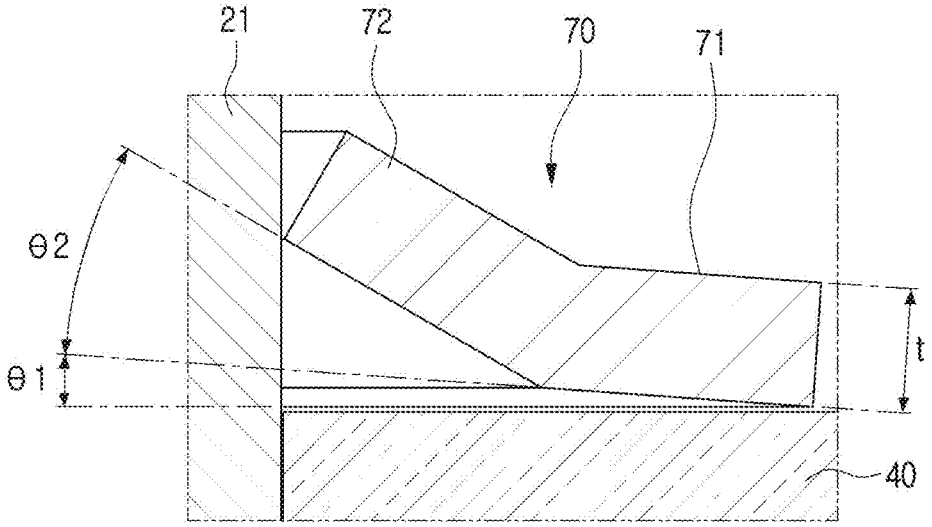
FIG. 10 is a cross-sectional view illustrating the fastener 70 of FIG. 9 taken along line A-A according to an embodiment of the disclosure.

FIG. 10 is a cross-sectional view illustrating the fastener 70 of FIG. 9 taken along line A-A according to an embodiment of the disclosure.

Referring to FIGS. 7, 8, and 9, the fastener 70 includes a ring portion 71 and a plurality of pressing portions 72.

The ring portion 71 is formed in a ring shape. The ring portion 71 is formed to be inserted into the fixed shaft 21.

Therefore, the inner diameter of the ring portion 71 is larger than the diameter of the fixed shaft 21.

The plurality of pressing portions 72 are formed on the inner circumferential surface of the ring portion 71. The plurality of pressing portions 72 are formed to protrude from the inner circumferential surface of the ring portion 71 toward the center thereof. The plurality of pressing portions 72 are formed at regular intervals along the inner circumferential surface of the ring portion 71.

The tips of the plurality of pressing portions 72 may be formed to form one circle. In other words, the tips of the plurality of pressing portions 72 may form a circular hole. Accordingly, the tips of the plurality of pressing portions 72 may be formed as a curved surface having the same radius curvature. The diameter D3 of the hole formed by the tips of the plurality of pressing portions 72 is referred to as the inner diameter of the plurality of pressing portions 72.

The inner diameter D3 of the plurality of pressing portions 72 may be determined so that the fastener 70 is press-fitted and fixed to the fixed shaft 21, thereby supporting the stator 40. To this end, the inner diameter D3 of the plurality of pressing portions 72 may be set smaller than the diameter D2 of the fixed shaft 21. For example, the difference between the diameter D2 of the fixed shaft 21 and the inner diameter D3 of the plurality of pressing portions 72 may be 0.05 mm to 0.3 mm.

In the case that the difference between the diameter D2 of the fixed shaft 21 and the inner diameter D3 of the plurality of pressing portions 72 is less than 0.05 mm, the fastener 70 may not support the stator 40 when the fastener 70 is coupled to the fixed shaft 21. When the difference between the diameter D2 of the fixed shaft 21 and the inner diameter D3 of the plurality of pressing portions 72 exceeds 0.3 mm, the fastener 70 may deform the shaft hole 22 formed inside the fixed shaft 21. When the shaft hole 22 is deformed, the rotating shaft 60 may not rotate smoothly so that noise may be generated.

As illustrated in FIG. 7, in this embodiment, the fastener 70 includes six pressing portions 72. However, the number of pressing portions 72 is not limited thereto. As another example, the fastener 70 may include three or more pressing portions 72.

The plurality of pressing portions 72 are formed to be inclined upward with respect to the ring portion 71 so that the fastener 70 may fix the stator 40 when an impact is applied to the reciprocating compressor 1. For example, the plurality of pressing portions 72 may be formed so that the fastener 70 supports the maximum amount of impact that may occur during distribution of the reciprocating compressor 1. Here, the maximum amount of impact=weight of reciprocating compressor x free fall speed×3.

To this end, when the fastener 70 is coupled to the fixed shaft 21, one surface of the fastener 70 facing the stator 40 may be formed to form a double slope with respect to the contact surface of the stator 40.

The plurality of pressing portions 72 are formed in the same shape. Therefore, the following description will be based on one pressing portion 72.

The pressing portion 72 is formed to be inclined upward with respect to the ring portion 71. In other words, the pressing portion 72 may be formed to have an obtuse angle with respect to the upper surface of the ring portion 71. The lower surface of the pressing portion 72 may be inclined at an angle of approximately 25 to 35 degrees with respect to the lower surface of the ring portion 71.

The fastener 70 may be formed so that when the fastener 70 is coupled to the fixed shaft 21, the lower surface of the fastener 70 is formed to be double inclined with respect to the lower surface of the stator 40.

For example, when the fastener 70 is inserted into the fixed shaft 21 and the fastener 70 is brought into contact with one surface of the stator 40, the stator 40 is fixed to the fixed shaft 21 by the fastener 70. At this time, the fastener 70 may be fixed to the fixed shaft 21 by the elastic force of the plurality of pressing portions 72 and support the stator 40.

As illustrated in FIG. 10, when the fastener 70 is inserted into the fixed shaft 21 and the fastener 70 contacts the stator 40, the outer end of the lower surface of the fastener 70, e.g., the lower end of the outer circumferential surface of the ring portion 71, contacts the upper surface of the stator 40, and the inner end of the lower surface of the fastener 70, e.g., the lower end of the tip of the pressing portion 72, contacts the outer circumferential surface of the fixed shaft 21. At this time, the lower surface of the ring portion 71 is inclined at a first angle θ1 with the upper surface of the stator 40, and the lower surface of the pressing portions 72 is inclined at a second angle θ2 with the lower surface of the ring portion 71.

The first angle θ1 may be formed to be about 3 degrees to about 5 degrees so that the fastener 70 has spring elasticity. In addition, the second angle θ2 may be formed to be about 25 degrees to about 35 degrees so that the fastener 70 withstands the amount of impact applied to the reciprocating compressor 1.

Considering the press-fit workability of the fastener 70, the thickness t of the fastener 70 may be set to about 0.8 mm to about 1.2 mm. The thickness of the ring portion 71 may be the same as the thickness of the plurality of pressing portions 72.

In addition, the fastener 70 may include a plurality of outer protrusions 73. The plurality of outer protrusions 73 may be formed on the outer circumferential surface of the ring portion 71 at regular intervals. The plurality of outer protrusions 73 may be formed to protrude from the outer circumferential surface of the ring portion 71 in the radial direction of the ring portion 71. The plurality of outer protrusions 73 may be formed in an arc shape.

The plurality of outer protrusions 73 may be provided to center the fastener 70 with respect to the center of the fixed shaft 21 when the fastener 70 is press-fitted into the fixed shaft 21. The fastener 70 may be press-fitted into the fixed shaft 21 using a press-fitting jig. The plurality of outer protrusions 73 may be accommodated in and guided by a plurality of guide grooves of the press-fitting jig.

In the case of the embodiment as illustrated in FIGS. 7 and 9, the fastener 70 includes four outer protrusions 73. However, the number of outer protrusions 73 is not limited thereto. The plurality of outer protrusions 73 may be formed to have two or more outer protrusions 73.

Hereinafter, a case in which a snap ring 77 is used as the holder for fixing the stator 40 to the fixed shaft 21 will be described in detail with reference to FIG. 11.

Figure 11:
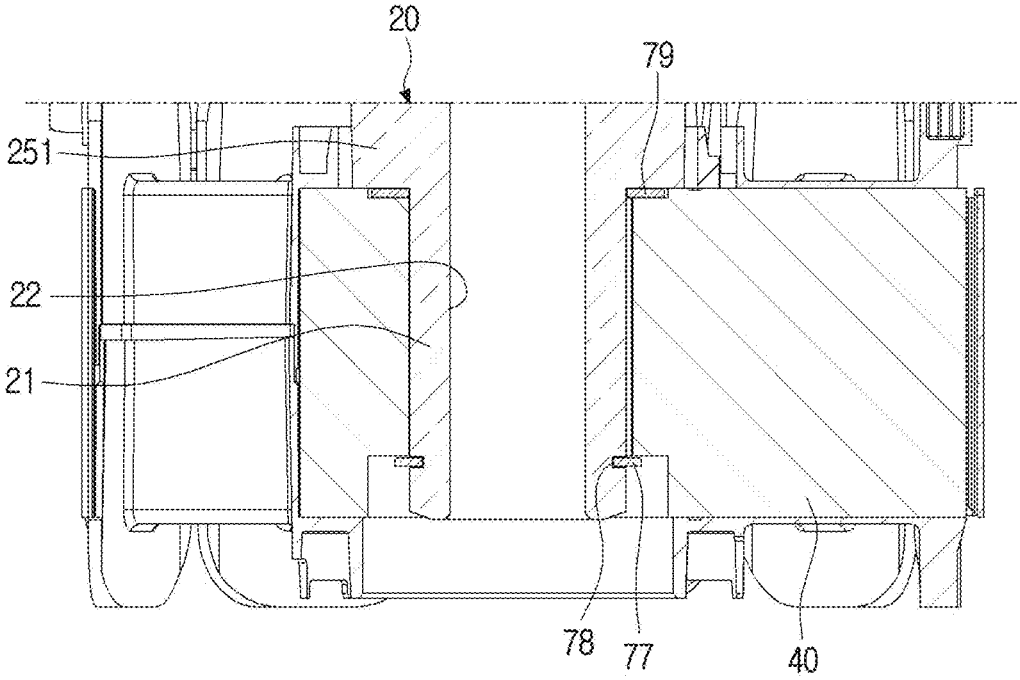
FIG. 11 is a partial cross-sectional view illustrating a stator 40 coupled to a fixed shaft 21 of a motor 30 used in a reciprocating compressor 1 according to an embodiment of the disclosure.

FIG. 11 is a partial cross-sectional view illustrating a stator 40 coupled to a fixed shaft 21 of a motor 30 used in a reciprocating compressor 1 according to an embodiment of the disclosure.

Referring to FIG. 11, a ring groove 78 is formed on the outer circumferential surface of the fixed shaft 21. The ring groove 78 is formed on the outer circumferential surface of the fixed shaft 21 below the stator 40. The ring groove 78 may be formed along the entire circumference of the outer circumferential surface of the fixed shaft 21. The ring groove 78 is formed to accommodate the snap ring 77.

The snap ring 77 is coupled to the ring groove 78. As the snap ring 77, a general snap ring for an axis may be used.

A spring washer 79 may be disposed between the bearing block 20 and the stator 40. In detail, the spring washer 79 may be disposed between the lower surface of the step portion 251 of the bearing block 20 and the upper surface of the stator 40.

The distance from the lower surface of the step portion 251 of the bearing block 20 to the ring groove 78 may be determined to correspond to the height of the stator 40. In other words, the distance from the lower surface of the step portion 251 to the ring groove 78 may be determined so that when installing the spring washer 79 between the lower surface of the step portion 251 of the bearing block 20 and the stator 40 and inserting the snap ring 77 into the ring groove 78, the lower surface of the stator 40 is in contact with the snap ring 77.

As illustrated in FIG. 11, when the stator 40 is fixed to the fixed shaft 21 using the spring washer 79 and the snap ring 77, the stator 40 does not move up and down with respect to the fixed shaft 21.

In the reciprocating compressor 1 according to one or more embodiments of the disclosure having the above-described structure, the fixed shaft 21 on which the stator 40 is disposed and the shaft hole 22 in which the rotating shaft 60 of the rotor 50 is disposed are formed as a single body, so it may have a small concentricity. By minimizing the concentricity of the outer circumferential surface of the fixed shaft 21 and the inner circumferential surface of the shaft hole 22, the bias of the air gap between the stator 40 and the rotor 50 may be minimized during assembly. Therefore, when the reciprocating compressor 1 operates at low speed, noise and vibration may be reduced.

In general, a refrigerator needs to rapidly cool the internal space to a predetermined temperature and maintain the internal temperature constant when the temperature of the internal space reaches the predetermined temperature. In this case, it is preferable to keep the temperature fluctuation range small. In order to reduce the range of temperature fluctuations, it is necessary to operate the reciprocating compressor at low speed. In addition, when the reciprocating compressor operates at low speed, power consumption may decrease.

However, in the case that the moment of inertia of the rotor of the motor used in the reciprocating compressor is small, when the reciprocating compressor operates at low speed, the shake of the rotor increases, resulting in increased noise, vibration, and speed fluctuation rate. In the case that the moment of inertia of the rotor is large, the shake of the rotor is small. Therefore, when the reciprocating compressor operates at low speed, noise, vibration, and speed fluctuation rate may be reduced.

In the case of the reciprocating compressor according to the related art using an inner rotor motor in which the rotor is disposed inside the stator, the size of the rotor cannot be increased, so the moment of inertia of the rotor cannot be increased. Therefore, the reciprocating compressor using the inner rotor motor according to the related art has high noise, vibration, and speed fluctuation rate when operated at low speed.

However, the reciprocating compressor 1 according to one or more embodiments of the disclosure uses the outer rotor motor in which the rotor 50 is disposed on the outside of the stator 40, so the moment of inertia of the rotor 50 may be increased. Therefore, the reciprocating compressor 1 according to one or more embodiments of the disclosure may reduce noise, vibration, and speed fluctuation rate when operated at low speed compared to the reciprocating compressor according to the related art. Accordingly, the reciprocating compressor 1 according to one or more embodiments of the disclosure may have improved low-speed efficiency compared to the reciprocating compressor according to the related art.

In addition, in the reciprocating compressor 1 according to one or more embodiments of the disclosure, because the shaft hole 22 where the rotating shaft 60 of the rotor 50 is disposed is formed in the inside of the fixed shaft 21 where the stator 40 is disposed, the concentricity of the shaft hole 22 and the outer circumferential surface of the fixed shaft 21 may be reduced. Therefore, when assembling the motor 30, the eccentricity of the air gap between the stator 40 and the rotor 50 may be minimized, and thus noise and vibration may be reduced when the reciprocating compressor 1 is operated at low speed.

Hereinafter, a method of assembling a reciprocating compressor according to one or more embodiments of the disclosure will be described with reference to FIGS. 12A to 12E. In detail, a method of assembling the motor 30 to the bearing block 20 of the reciprocating compressor 1 will be described.

FIGS. 12A, 12B, 12C, 12D, and 12E are perspective views illustrating a method of assembling a reciprocating compressor according to various embodiments of the disclosure.

Figure 12A:
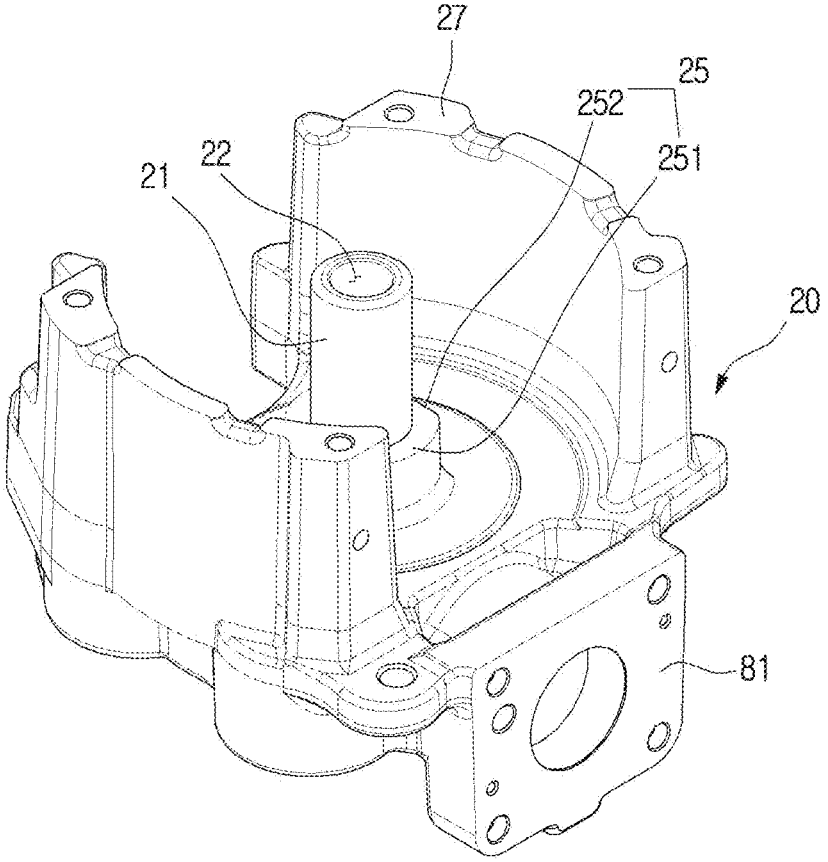
FIGS. 12A, 12B, 12C, 12D, and 12E are perspective views illustrating a method of assembling a reciprocating compressor 1 according to various embodiments of the disclosure.

First, referring to FIG. 12A, a bearing block 20 is prepared. The bearing block 20 may include a fixed shaft 21, a pair of legs 27, and a cylinder block 81.

The fixed shaft 21 is formed at the center of the pair of legs 27. A shaft hole 22 is formed in the center of the fixed shaft 21. The outer circumferential surface of the fixed shaft 21 and the shaft hole 22 may be processed to be concentric. Because the outer circumferential surface of the fixed shaft 21 and the shaft hole 22 may be processed in the same machining process, the concentricity of the outer circumferential surface of the fixed shaft 21 and the shaft hole 22 may be minimized.

The bearing block 20 is placed on the workbench so that the fixed shaft 21 faces upward.

Figure 12B:
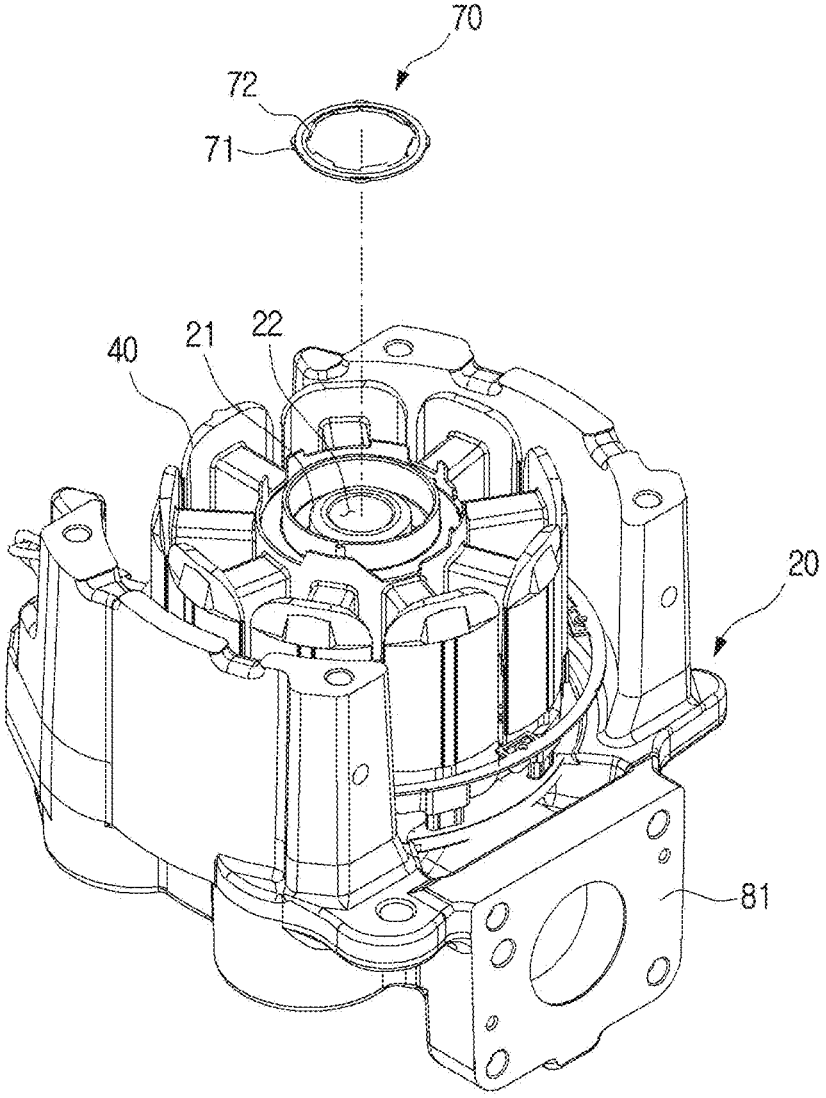

Next, referring to FIG. 12B, the stator 40 is inserted into the fixed shaft 21 of the bearing block 20. In detail, the fixed shaft 21 is inserted into the coupling hole 41 of the stator 40. At this time, because the diameter of the coupling hole 41 of the stator 40 is larger than the diameter of the fixed shaft 21, the fixed shaft 21 may be inserted into the stator 40 without interference.

When inserting the fixed shaft 21 into the stator 40, the rotation prevention part 25 of the bearing block 20 is inserted into the fixing groove 45 provided on the lower surface of the stator 40. In other words, after aligning the D-cut portion 252 of the step portion 251 of the bearing block 20 with the D-cut groove 45 of the stator 40, the fixed shaft 21 is inserted into the stator 40. Then, the step portion 251 of the bearing block 20 is inserted into the D-cut groove 45 of the stator 40, so that the stator 40 does not rotate with respect to the fixed shaft 21.

Next, the holder (e.g., the fastener 70 or the snap ring 77) is disposed on the fixed shaft 21 to fix the stator 40.

Figure 12C:
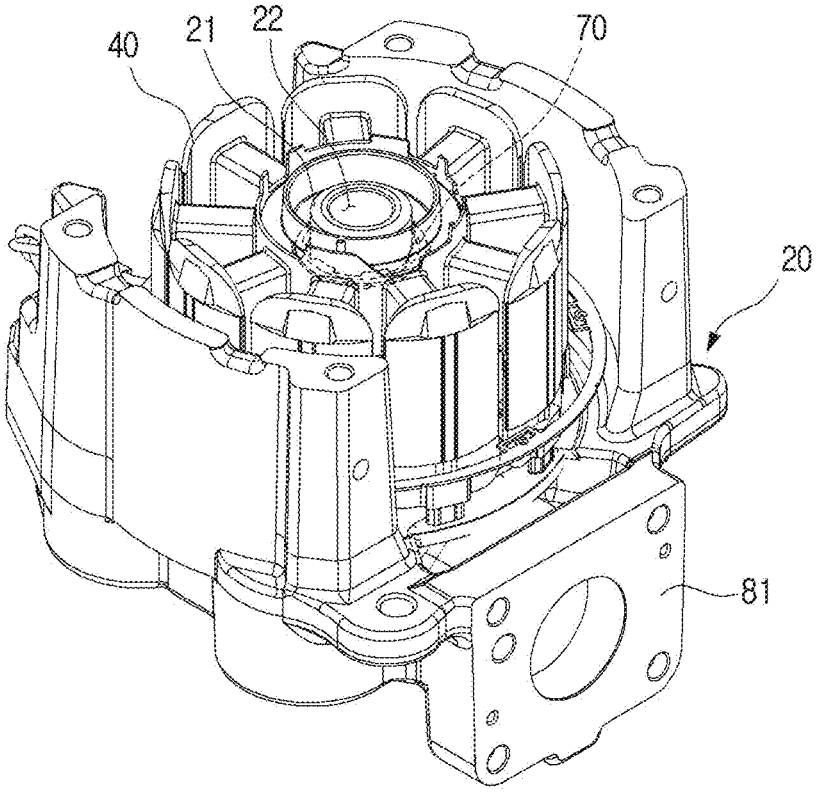

For example, referring to FIG. 12C, the fastener 70 is press-fitted into the fixed shaft 21 so that the fastener 70 contacts the upper surface of the stator 40. In detail, the fixed shaft 21 is inserted into the hole of the fastener 70 formed by the plurality of pressing portions 72, and the fastener 70 is pressed downward so that the lower surface of the fastener 70 is in contact with the upper surface of the stator 40.

At this time, because the inner diameter of the plurality of pressing portions 72 of the fastener 70 is smaller than the diameter of the fixed shaft 21, the fastener 70 may not be easily inserted into the fixed shaft 21. The fastener 70 may be press-fitted into the fixed shaft 21 using a press-fitting jig. The press-fitting jig may guide the fastener 70 to be press-fitted into the fixed shaft 21 using a plurality of outer protrusions 73 of the fastener 70.

As another example, the stator 40 may be fixed to the fixed shaft 21 using a snap ring 77 and a spring washer 79 (see FIG. 11).

In this case, before inserting the fixed shaft 21 of the bearing block 20 into the stator 40, the fixed shaft 21 is inserted into the spring washer 79. In detail, the fixed shaft 21 is inserted into the spring washer 79, and the spring washer 79 is positioned on the upper surface of the step portion 251 of the bearing block 20.

Next, the stator 40 is inserted into the fixed shaft 21. Thus, the spring washer 79 is positioned between the step portion 251 of the bearing block 20 and the lower surface of the stator 40.

Then, when the snap ring 77 is coupled to the ring groove 78 of the fixed shaft 21, the stator 40 is fixed to the fixed shaft 21 of the bearing block 20.

Figure 12D:
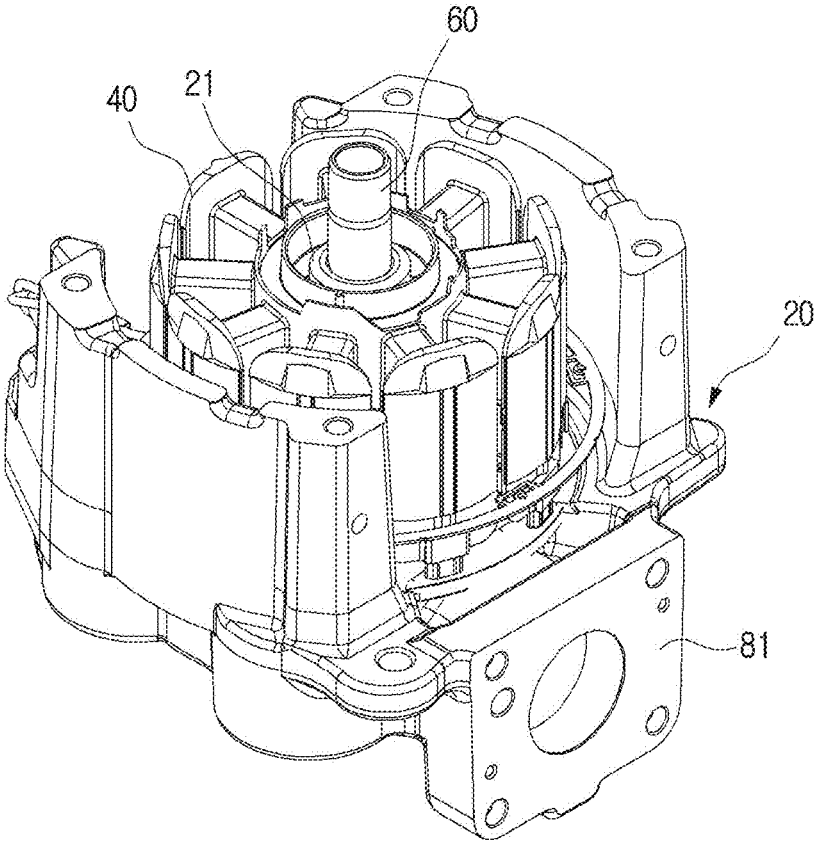

Next, referring to FIG. 12D, the rotating shaft 60 is inserted into the shaft hole 22 of the fixed shaft 21. At this time, the rotating shaft 60 is inserted into the shaft hole 22 of the fixed shaft 21 from the lower side of the bearing block 20. Thus, one end of the rotating shaft 60 protrudes upward from the stator 40.

Figure 12E:
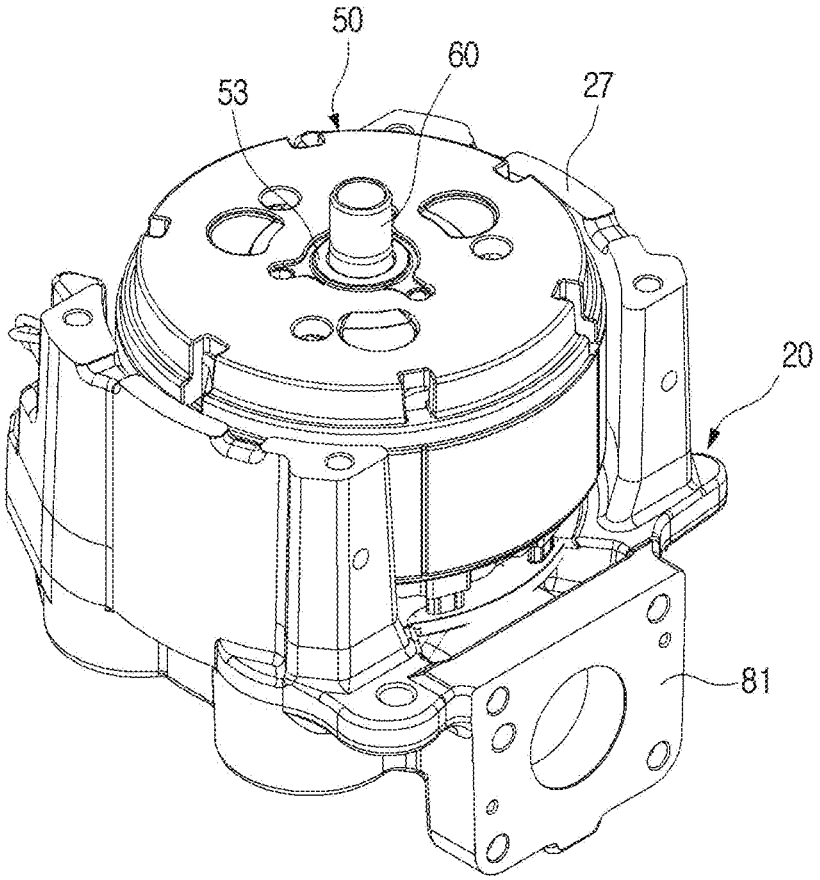

Finally, referring to FIG. 12E, the rotor 50 is coupled to the rotating shaft 60. In detail, the fixed boss 53 of the rotor 50 is press-fitted into one end of the rotating shaft 60 protruding upward from the stator 40 to couple the rotating shaft 60 and the rotor 50. Because the rotor 50 is press-fitted and fixed to one end of the rotating shaft 60, when the rotor 50 is located below the bearing block 20 as illustrated in FIG. 2, the rotor 50 does not fall off the rotating shaft 60.

Because the reciprocating compressor according to the related art using an inner rotor motor has a structure in which the stator and the rotor are not fixed on the same axis, a process of aligning and fixing the center of the stator and the center of the rotor and a process of inspecting whether the center of the stator and the center of the rotor match are required.

However, in the reciprocating compressor 1 according to one or more embodiments of the disclosure, the rotating shaft 60 of the rotor 50 is coupled to the inside of the fixed shaft 21 on which the stator 40 is disposed, so the center of the stator 40 and the center of the rotor 50 may easily be aligned. Therefore, the reciprocating compressor 1 according to one or more embodiments of the disclosure may be easier to assemble than the reciprocating compressor of the related art.

While the disclosure has been shown and described with reference to various embodiments thereof, it will be understood by those skilled in the art that various changes in form and detail may be made therein without departing from the spirit and scope of the disclosure as defined by the appended claims and their equivalents.

What is claimed is:

1. A reciprocating compressor, comprising:

a bearing block;

a fixed shaft extending vertically from a lower surface of the bearing block, formed in a cylindrical shape, and having a shaft hole formed therein;

a stator disposed on the bearing block and including a coupling hole into which the fixed shaft is inserted;

a holder disposed on an outer circumferential surface of the fixed shaft and configured to fix the stator to the bearing block;

a rotating shaft inserted into the shaft hole of the fixed shaft; and a rotor disposed outside the stator and fixed to one end of the rotating shaft, wherein the outer circumferential surface of the fixed shaft and the shaft hole are formed concentrically, wherein the holder includes a fastener, wherein the fastener comprises:

a ring portion having an inner diameter larger than a diameter of the fixed shaft, and a plurality of pressing portions protruding from an inner circumferential surface of the ring portion toward a center thereof, wherein the plurality of pressing portions are formed to be inclined with respect to the ring portion, and wherein an inner diameter of the plurality of pressing portions is smaller than the diameter of the fixed shaft.

2. The reciprocating compressor of claim 1, wherein concentricity of the outer circumferential surface of the fixed shaft and the shaft hole is less than 0.5 micrometers (μm).

3. The reciprocating compressor of claim 1, wherein difference between the diameter of the fixed shaft and the inner diameter of the plurality of pressing portions is 0.05 millimeters (mm) to 0.3 mm.

4. The reciprocating compressor of claim 1, wherein the plurality of pressing portions are formed in a same shape.

5. The reciprocating compressor of claim 1, wherein the plurality of pressing portions are formed so that the fastener supports a maximum amount of impact corresponding to three times a weight of the reciprocating compressor multiplied by a free fall speed.

6. The reciprocating compressor of claim 1, wherein the fastener is formed so that when the fastener is coupled to the fixed shaft, one surface of the fastener facing the stator is inclined an angle of 25 to 35 degrees with respect to a lower surface of the ring portion.

7. The reciprocating compressor of claim 1, wherein the fastener is formed so that when the fastener is coupled to the fixed shaft, one surface of the fastener facing the stator is double inclined with respect to a contact surface of the stator.

8. The reciprocating compressor of claim 7, wherein a lower surface of the ring portion is inclined at a first angle of 3 to 5 degrees with respect to the contact surface of the stator, and wherein a lower surface of the plurality of pressing portions are inclined at a second angle of 25 to 25 degrees with respect the lower surface of the ring portion.

9. The reciprocating compressor of claim 1, wherein the holder includes a snap ring, wherein the fixed shaft includes a ring groove in which the snap ring is accommodated, and wherein a spring washer is disposed between the bearing block and the stator.

10. The reciprocating compressor of claim 1, further comprising:

a rotation prevention part provided between the fixed shaft and the bearing block, wherein the stator includes a fixing groove formed on one surface of the stator facing the bearing block and corresponding to the rotation prevention part.

11. The reciprocating compressor of claim 10, wherein the rotation prevention part is formed as a step portion including a D-cut portion, and wherein the fixing groove is formed as a D-cut groove corresponding to the step portion including the D-cut portion.

12. The reciprocating compressor of claim 1, wherein a diameter of coupling hole of the stator is larger than a diameter of the fixed shaft.

13. The reciprocating compressor of claim 12, wherein a difference between the diameter of the coupling hole of the stator and the diameter of the fixed shaft is 0.1 millimeters (mm) to 0.3 mm.

14. The reciprocating compressor of claim 1, wherein the rotor comprises:

a disk, a skirt extending vertically from an edge of the disk, and a fixed boss disposed at a center of the disk, and wherein one end of the rotating shaft is press-fitted to the fixed boss.

* * * * *